US007431669B2

(12) United States Patent
Lemons et al.

(10) Patent No.: US 7,431,669 B2
(45) Date of Patent: Oct. 7, 2008

(54) LOW COMPRESSION GOLF BALL

(75) Inventors: Lane D. Lemons, Jackson, TN (US); Frank M. Simonutti, Jackson, TN (US); Robert T. Thurman, Humboldt, TN (US)

(73) Assignee: Wilson Sporting Goods Co., Chicago, IL (US)

( * ) Notice: Subject to any disclaimer, the term of this patent is extended or adjusted under 35 U.S.C. 154(b) by 525 days.

(21) Appl. No.: 11/078,755

(22) Filed: Mar. 11, 2005

(65) Prior Publication Data

US 2005/0159247 A1 Jul. 21, 2005

Related U.S. Application Data

(60) Division of application No. 10/752,634, filed on Jan. 7, 2004, which is a continuation-in-part of application No. 10/226,032, filed on Aug. 22, 2002.

(51) Int. Cl.
*A63B 37/06* (2006.01)
*A63B 37/12* (2006.01)

(52) U.S. Cl. ..... 473/373; 473/378

(58) Field of Classification Search ..... 473/351–378
See application file for complete search history.

(56) References Cited

U.S. PATENT DOCUMENTS 5,002,281 A * 3/1991 Nakahara et al. ..... 473/373
5,947,842 A * 9/1999 Cavallaro et al. ..... 473/373
5,965,669 A * 10/1999 Cavallaro et al. ..... 525/221
5,984,806 A * 11/1999 Sullivan et al. ..... 473/373
6,613,842 B2 * 9/2003 Rajagopalan ..... 525/193
6,623,380 B2 * 9/2003 Jordan ..... 473/372

* cited by examiner

*Primary Examiner*—Gene Kim
*Assistant Examiner*—Alvin A Hunter
(74) *Attorney, Agent, or Firm*—Terence P. O'Brien; Paul E. Schaafsma

(57) ABSTRACT

A golf ball (20) in accordance with the principles of the present invention has a core (22) with a low compression, but has at least two additional layers (24, 26) that provide for increased durability and control. The core (22) is formed of a polybutadiene compound that produces a zero (or less) compression. The mantle (24) is molded around the core (22) using terpolymers, which are comprised of ethylene, acrylic acid and n-butyl acrylate, with 100% of the acrylic acid groups neutralized with metal ions. The mantle (24), when molded, yields a deflection of greater than 0.170 inches under an applied static load of 200 lb. This correlates to a PGA compression of between about −20 and 15. The cover (26) is molded using conventional ionomers and "very low modulus" ionomers (V.L.M.I.), and has a hardness of between about 50 and 75 on a Shore D scale.

20 Claims, 1 Drawing Sheet

LOW COMPRESSION GOLF BALL

RELATED U.S. APPLICATION DATA

This application is a division of U.S. patent application Ser. No. 10/752,634 filed Jan. 7, 2004 entitled "Low Compression Golf Ball" by Lemons et al., which is a continuation-in-part of U.S. patent application Ser. No. 10/226,032 filed Aug. 22, 2002, entitled "Multilayered Balanced Golf Ball" by Simonutti and Bradley and incorporated herein by reference.

FIELD OF THE INVENTION

The present invention relates to the field of golf balls.

BACKGROUND OF THE INVENTION

The golf club/ball impact can best be described as a violent collision. The typical professional can swing a 200 gram (7.06 ounces) to 300 gram (10.6 ounces) driver and attain club speeds at the moment of impact of 105 to 115 mph, striking a 46 gram (1.62 ounces) golf ball resting on a tee. One side of the golf ball is struck with a golf club which can result in the balls of the prior art compressing nearly 50% before the golf ball leaves the tee. The golf ball then accelerates from rest to speeds of approximately 230 ft/s (70 m/s) to 240 ft/s (73 m/s) and spin rates of 2000 to 4000 rpm's in less than half a millisecond, experiencing 50,000 times the force of gravity.

For a great number of years, golf balls were molded using wound cores, which comprised a soft rubber center surrounded by a layer of thread rubber windings. In the late 1960s to early 1970s, balls with ionomer covers (produced by E.I. du Pont de Nemours and Company, 1007 Market ST Wilmington, Del. 19898 ("DuPont") under the trade name Surlyn®) were introduced. Balls molded with Surlyn® covers were produced with both thread wound cores and solid rubber cores. The balls molded using initial grades of Surlyn® and solid cores (hereafter referred to as "two-piece balls") were significantly less expensive to produce; however, the initial two-piece golf balls were hard, having an unpleasant feel to the golfer.

In the late 1980s, DuPont came out with softer Surlyn® terpolymer grades, known as Very Low Modulus Ionomers (V.L.M.I.). These materials allowed for development of two-piece golf balls with softer covers; however, use of high levels of V.L.M.I. results in a significant detrimental effect on the golf ball resilience. The limitation on balls made with V.L.M.I. materials was (is) that use of high levels of V.L.M.I. materials has a significant detrimental effect on golf ball resilience properties. Therefore, golf balls with soft covers could be made, but had relatively high compression; thus exhibiting high spin rates and low velocity.

In the mid- to late-1990s, softer, i.e. lower compression, distance type golf balls were developed. These golf balls included the addition of an intermediate cover layer. The additional layer allowed for greater control of the performance properties of the golf ball. In the late 1990's, multilayer golf balls utilizing polyurethane outer covers were introduced. These balls where rapidly adopted by professional golfers due to their premium qualities. However, these balls required a hard feel to achieve the desired distance and spin properties.

Through a softer core, a golf ball molded with a stiff ionomer had a reasonable feel based upon a relatively low compression; however, the core compression can only be reduced to a certain level (a Professional Golfers Association (PGA) compression of about 35) while retaining acceptable ball durability. If a core compression of below about 35 was used, impact durability of the golf ball was poor. A favorable byproduct of the use of a soft compression core in a golf ball was a lower spin rate, which allowed for better accuracy of the golf ball.

In 1998, Wilson Sporting Goods Co. ("Wilson"), 8700 West Bryn Mawr Avenue, Chicago, Ill. 60631, introduced a golf ball made using a core with about a 35 compression (sold under the trademark Staff® Titanium Straight Distance. To keep the velocity and performance properties of a premium distance golf ball, Wilson used a stiff ionomer cover layer on this ball. The ball compression of this golf ball was approximately 85, which was low for the time when it was introduced.

Existing golf balls, however, have some drawbacks. Prior art golf balls are generally manufactured with a core made primarily from polybutadiene rubber, which is covered with a fairly hard, thin, ionomer inner cover layer, which is subsequently covered by the polyurethane or balata/polybutadiene outer cover layer. While providing adequate playing characteristics at a less expensive production cost, these solid balls exhibit lower velocities at driver impact than wound balls using like cover materials. Prior art golf balls utilized either thermoplastic or thermoset material for the covers. The prior art thermoplastic material allows for greater ease in manufacturing, but reduces resilience. Conversely, thermoset material is difficult with which to work, but provides needed resilience.

In addition, all of the various materials used in the construction of golf balls, from wound core constructions through to multi-layer solid core constructions, have varying densities. Accordingly, the mass per unit volume of these materials varies. For example, typically, the materials used to produce the cover layer possess a lower mass per unit volume than the materials used to produce the core. Additionally, the material composition of most intermediate layers has a density or a weight per unit volume that is different than the density or weight per unit volume of the core and/or the cover layer. If a golf ball is manufactured perfectly, that is if the core or center of a ball is perfectly spherical, and if the cover layer thickness and intermediate layer thickness (if applicable) are constant throughout the entire ball, the ball will be "balanced", and should fly true when struck with a golf club, or should roll true when putted.

More recently, golf balls have been developed with significantly lower ball compression than was previously considered possible for a premium two-piece golf ball. The Precept® Lady and Laddie golf balls (produced by Bridgestone Sports Co., LTD., Omori Bellport E Bldg. 6-22-7, Minami-oi Shinagawa-ku, Tokyo 140-0013 Japan), and the Titleist® NXT Distance golf balls (produced by Fortune Brands, Inc., 300 Tower Parkway, Lincolnshire, Ill. 60069), were introduced in the early 2000s. These golf balls have compressions ranging from about 55 (the Precept® Laddie) to the mid to upper 60s (Titleist® NXT Distance and Precept® Lady). These balls are designed to produce low ball compression through the use of softer cover materials (ionomer blends comprising varying levels of V.L.M.I. materials). However, existing golf ball cores are not formed with a compression value below 35. Further, the lowest compression golf ball currently made that performs with properties acceptable for a premium golf ball is the Precept® Laddie, with a compression in the low 50s.

Thus, there exists a need for a golf ball which has a low compression and maintains the performance and properties expected from a premium golf ball, such as, but not limited to low spin rate, good feel and good impact durability.

SUMMARY OF THE INVENTION

A golf ball in accordance with the principles of the present invention has a low compression and maintains the performance and properties expected from a premium golf ball, such as, but not limited to low spin rate, good feel and good impact durability. Although initial velocity properties are often proportional to compression, a significantly lower compression is achieved than prior art products and comparable or even somewhat improved initial velocity and flight performance properties are retained. In accordance with the principles of the present invention, the golf ball has a core with a low compression and has at least two additional layers that provide for increased durability and control.

In one embodiment, the golf ball is composed of at least three-pieces, wherein the innermost, or core layer, is formed of a polybutadiene compound that produces a zero (or less) compression. The core comprises high cis-content polybutadiene rubber, a co-crosslinking agent, and a free radical initiator. The core may also comprise a filler to adjust the specific density of the core. The mantle is molded around the core using newly developed terpolymers from DuPont. These new terpolymers are comprised of ethylene, acrylic acid, and n-butyl acrylate, with 100% of the acrylic acid groups neutralized with metal ions. Further, these polymers contain a minimum of five parts per hundred (phr) of a magnesium fatty acid salt. The presence of such a salt allows for low stiffness and unexpectedly high resilience properties. Surprisingly, by using these new terpolymers golf balls of the present invention retain acceptable resilience (coefficient of restitution, initial velocity) properties despite low compression. The mantle, when molded, yields a deflection of greater than about 0.170 inches (4.32 mm) under an applied static load of 200 lb. (90.7 kg). This correlates to a PGA compression of between about −20 and 15. The mantle may also comprise a filler to adjust the specific density of the core. The cover is molded using conventional ionomers and V.L.M.I. The ball cover has a hardness of between about 50 and 75 on a Shore D scale.

BRIEF DESCRIPTION OF THE DRAWING

The FIGURE depicts a cross sectional view of a golf ball in accordance with the principles of the present invention.

DETAILED DESCRIPTION OF THE INVENTION

Figure 1:
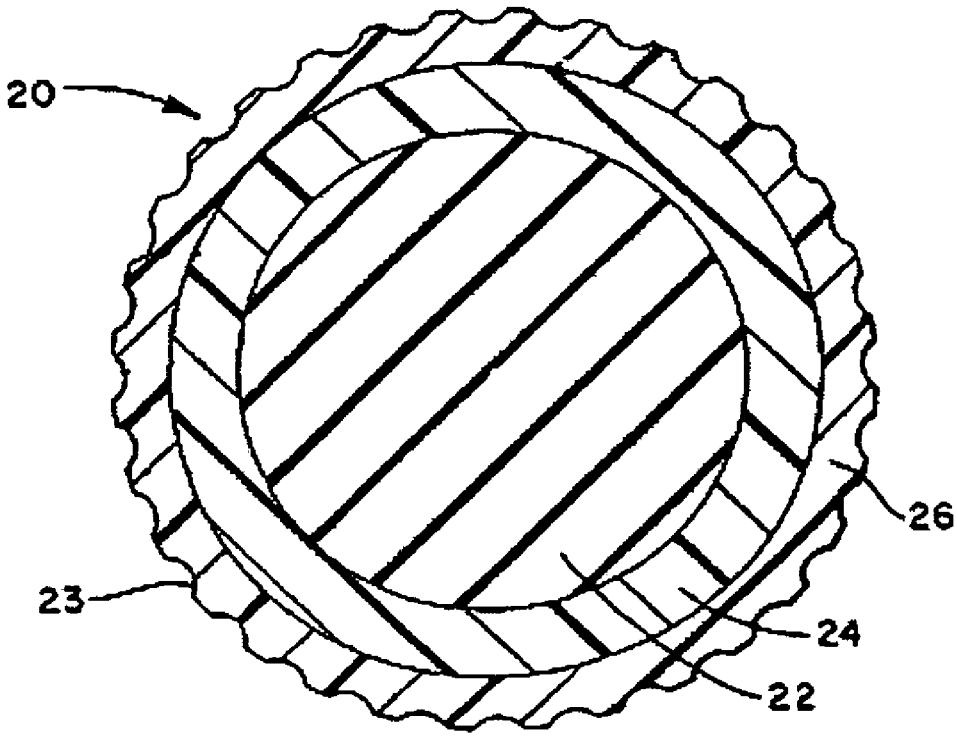

A golf ball 20 in accordance with the principles of the present invention has a low compression and maintains the performance and properties expected from a premium golf ball, such as, but not limited to low spin rate, good feel, and good impact durability. In accordance with the principles of the present invention, the golf ball has a core 22 with a high deflection under a 200 lb. static load, but has at least two additional layers that provide for increased durability and control.

Referring to the FIGURE, in one embodiment in accordance with the principles of the present invention an at least three-piece solid golf ball 20 is provided. The center layer or core 22 is formed of a polybutadiene compound that has a deflection of greater than 0.160 inches (4.06 mm) under an applied static load of 200 lb. (90.7 kg). Using a generally accepted conversion of deflection to compression (Compression=160−(Deflection*1000)) the defined deflection equates to a compression of zero (or less) compression. The intermediate layer or mantle 24 is molded around the core 22 using newly developed terpolymers from DuPont, available under the tradename DuPont® HPF™. These new terpolymers are comprised of ethylene, acrylic acid, and n-butyl acrylate, with 100% of the acrylic acid groups neutralized with metal ions. Further, the terpolymers comprise at least five phr of a magnesium fatty acid salt. Surprisingly, by using these new terpolymers, golf balls 20 of the present invention retain acceptable resilience (coefficient of restitution, initial velocity) properties despite low compression. The mantle 24, when molded, yields a deflection of greater than about 0.150 inches (3.81 mm) under an applied static load of 200 lb. (90.7 kg). This correlates to a PGA compression of between about −20 and 15. The outer or cover layer 26 is molded using materials including but not limited conventional ionomers, ionomer blends, DuPont® HPF™ modified polymers, thermoplastic urethane, balata, balata/urethane blends and V.L.M.I. The cover layer 26 can have a hardness of between about 50 and 75 on a Shore D scale, preferably between 52 and 65. In another preferred embodiment, the cover layer 26 can have a hardness within the range of 68-73 on a Shore D hardness scale. In yet another preferred embodiment, the cover layer 26 can have a hardness within the range of 58-64 on a Shore D hardness scale.

More specifically, the core 22 is comprised of a high cis-content polybutadiene rubber, a co-crosslinking agent, a free radical initiator, and fillers as necessary to provide acceptable density. The cis-1,4 content of the polybutadiene preferably should be greater than about 94%. polybutadiene rubber suitable for use as the center can be synthesized using nickel, cobalt or neodymium catalysts. Polybutadiene materials made using neodymium catalyzed materials, such as Enichem BR-40 (manufactured by Polimeri Europa Americas, Inc. Ltd., 200 West Loop South, Suite 2010, Houston, Tex. 77027), or nickel catalyzed materials, such as Kinex 7245 (Manufactured by The Goodyear Tire & Rubber Company 1144 E. Market Street Akron, Ohio 44316), are preferred. The co-crosslinking agent is preferably a Zinc salt of an unsaturated acrylate ester. Zinc diacrylate is a preferred metal salt. Further, a level of fatty acid salt of up to about 12% of the total of the zinc diacrylate and fatty acid salt is preferred.

The preferred free radical initiator is a peroxide. Peroxides such as dicumyl peroxide, tert-butyl peroxybenzoate, butyl 4,4'-di-(tert-butylperoxy) valerate, and 1,1-di-(tert-butylperoxy)-3,3,5-trimethylcyclohexane are suitable for use. 1,1-di-(tert-butylperoxy)-3,3,5-trimethylcyclohexane (sold by Akzo Nobel Inc., 525 West Van Buren Street, Chicago, Ill. 60607 under the trade name Triganox® 29/40) is preferred for use in the core compound. Fillers suitable for use in adjusting the density of the core 22 can be chosen from the group consisting of inorganic materials, organic materials, and combinations thereof. Preferred materials for adjusting the density of the core 22 include inorganic materials such as zinc oxide, barium sulfate, titanium dioxide, and combinations thereof. In a preferred embodiment, the specific gravity of the core 22 is adjusted to a target of 1.125 using fillers.

The mantle 24 is preferably formed from a terpolymer of ethylene; an α,β-unsaturated carboxylic acid; and an n-alkyl acrylate. Preferably, the α,β-unsaturated carboxylic acid is acrylic acid, and the n-alkyl acrylate is n-butyl acrylate. The carboxylic acid in the mantle 24 is 100% neutralized with metal ions, preferably magnesium ions; if the material used in the mantle 24 is not 100% neutralized, the resultant resilience properties such as coefficient of restitution (C.O.R.) and initial velocity will not be sufficient to produce the performance required for a premium golf ball. Further, the mantle 24 material will comprise at least five phr of a magnesium fatty acid salt. The C.O.R is a measurement of the amount of energy returned in an inelastic collision, such as the impact between the golf ball and the club face. It is expressed as a ratio of energy present in the system before the impact to energy present in the system just after impact. This relates to the energy present in the ball and clubhead velocity just after the ball/club impact.

The mantle 24 can comprise various levels of the three components of the terpolymer as follows: from ~60% to 80% ethylene; from ~8% to 20% by weight of the α,β-unsaturated carboxylic acid; and from ~0% to 25% of the n-alkyl acrylate, preferably 5% to 25%. The terpolymer will also contain an amount of a fatty acid salt, preferably magnesium oleate. These materials are commercially available under the trade name DuPont® HPF™. In a preferred embodiment, a terpolymer suitable for the invention will comprise from ~75% to 80% by weight ethylene, from ~8% to 12% by weight of acrylic acid, and from ~8% to 17% by weight of n-butyl acrylate, wherein all of the carboxylic acid is neutralized with magnesium ions, and comprises at least five phr of magnesium oleate.

In another preferred embodiment, the cover layer 26 will comprise a terpolymer of ~70% to 75% by weight ethylene, ~10.5% by weight acrylic acid, and ~15.5% to 16.5% by weight n-butyl acrylate. The acrylic acid groups are 100% neutralized with magnesium ions. The terpolymer will also contain an amount of magnesium oleate. Materials suitable for use as this layer are sold under the trade name DuPont® HPF™ AD1027.

In yet another preferred embodiment, the mantle 24 comprises a copolymer comprising ~88% by weight of ethylene and ~12% by weight acrylic acid, with 100% of the acrylic acid neutralized by magnesium ions. The mantle 24 will also contain magnesium oleate. Material suitable for this embodiment was produced by DuPont as experimental product number SEP 1264-3. Preferably the mantle 24 is adjusted to a target specific gravity of 1.125 using inert fillers to adjust the density with minimal effect on the performance properties of the cover layer 26. Preferred fillers used for compounding the mantle 24 layer to the desired specific gravity include but are not limited to tungsten, zinc oxide, barium sulfate, and titanium dioxide.

The cover layer 26 can be formed from materials chosen from the ionomers, thermoplastic urethane, and polymers sold under the trade name DuPont® HPF™. The cover layer 26 is preferably formed of a blend of ionomers comprising ethylene; α,β-unsaturated carboxylic acid; and optionally an n-alkyl acrylate. In one preferred form, the cover layer 26 comprises a blend of high acid ionomers comprising about 80% to 82% by weight of ethylene and about 18% to 20% by weight of an α,β-unsaturated carboxylic acid, wherein about 40% to 70% of the carboxylic acid groups are neutralized with metal ions. Preferred metal ions include, but are not limited to: sodium, magnesium, lithium, and zinc. In this form, the ionomer cover layer 26 will have a hardness on a Shore D scale of about 68 or greater. Further preferred is a blend of ionomers which comprise one or more components neutralized with a monovalent metal ion and one or more components neutralized with a divalent metal ion. It is also further preferred that the cover layer 26 comprises dimples 23.

In yet another preferred embodiment, the cover layer 26 can comprise a blend of high acid ionomers. The blend of high acid ionomers comprise about 80% to 82% by weight of ethylene and about 18% to 20% by weight of an α,β-unsaturated carboxylic acid, wherein about 40% to 70% of the carboxylic acid is neutralized with a metal ion, and a V.M.L.I. comprising from about 67% to 70% by weight of ethylene, about 10% by weight of an α,β-unsaturated carboxylic acid, and from about 20% to 23% by weight of an n-alkyl acrylate, wherein about 70% by weight of the carboxylic acid is neutralized with metal ions. It is further preferred that the high-acid ionomers be neutralized with a monovalent metal ion, and the V.L.M.I. materials be neutralized using divalent metal ions. In this form, the ionomer cover layer 26 will have a Shore D hardness of between about 58 and 69. In an alternative embodiment, the cover layer 26 of the golf ball 20 can comprise a terpolymer of ethylene; an α,β-unsaturated carboxylic acid; and an n-alkyl acrylate, wherein 100% of the carboxylic acid is neutralized with metal ions.

In yet another embodiment, the cover layer 26 will comprise a blend of ~44% by weight of a copolymer of ~81% ethylene and ~19% methacrylic acid, wherein ~50% to 70% of the acid groups are neutralized with magnesium ions, and ~42% by weight of a terpolymer of ~67% to 70% ethylene, ~10% methacrylic acid, and ~20% to 23% n-butyl acrylate, wherein ~70% of the acid groups are neutralized by magnesium ions. The cover layer 26 of this embodiment has a Shore D hardness of about 64.

In yet another preferred embodiment, the cover layer 26 comprises a blend of ~35% by weight of a copolymer of ~81% ethylene and ~19% methacrylic acid, wherein ~50% of the acid groups are neutralized with Sodium ions, ~65% by weight of a terpolymer of ~67-70% ethylene, ~10% methacrylic acid and ~20% to 23% n-butyl acrylate, wherein ~70% of the acid groups are neutralized by magnesium ions. The cover layer 26 of this embodiment has a Shore D hardness of about 60.

In yet another preferred embodiment, the cover layer 26 will comprise a resin consisting of ~73% to 76% ethylene, ~8.5% to 10.5% acrylic acid, and ~15.5% to 16.5% n-butyl acrylate, wherein the acid groups are at least 100% neutralized with magnesium ions. The resin also contains an amount of fatty acid salt, preferably either magnesium stearate or magnesium oleate.

In one embodiment, the ball may be balanced. A balanced ball does not depart from its intended flight or roll path due to an off-center core or outer layers of inconsistent thickness. In accordance with the principles of the present invention the ball would have a core 22, mantle 24, inner and outer cover layer 26 that are of uniform density without any uneven areas of distribution. This can be accomplished by blending essentially non-reactive materials with the particular components of the golf ball 20. Thus, a truly balanced ball in accordance with the principles of the present invention has both a uniform density and a core 22 perfectly centered within the mantle 24 which is perfectly centered within the cover layer 26 which itself is of an even distribution. Materials suitable for use in adjusting the density of the component parts can be chosen from the group consisting of inorganic materials, organic materials, and combinations thereof. Preferred inorganic fillers comprise zinc oxide, barium sulfate, titanium dioxide, or a combination thereof.

An unbalanced ball will generally have a light spot and a heavy spot. When an unbalanced ball is repeatedly spun in a salt water solution of the float test described below, the ball will tend to consistently orient itself in the solution with its light spot up and its heavy spot down. The "float" test is performed by filling a container with warm water. A salt, such as sodium chloride, is then added to the solution in sufficient amount to enable one or more golf balls to float in the solution. Preferably, a few drops of detergent are added to the container. The ball is spun and when the ball stops spinning in water, then the top is marked. The spinning is repeated to determine if the same portion will again be at the top when the ball stops. A balanced ball would exhibit no orientational preference when placed in a salt bath of equivalent density. In a preferred embodiment, the cover layer 26 is adjusted to a target specific gravity of about 1.125 using inert fillers. In a preferred embodiment of the present invention, the core, mantle 24, and cover layer 26 all have a specific gravity of between about 1.118 and about 1.132, with the golf ball 20 preferably having a specific gravity of about 1.125.

Golf balls made in accordance with the principles of the present invention have improved performance properties as illustrated by the examples set forth below. The balls of the present invention, when struck by a golf club at high swing speed, exhibit a deformation of the ball sufficient to affect the center. This effect of this is to provide an exception feel a low spin rate, and exceptional distance (particularly off of the tee). As the impact speed, i.e. swing speed, decreases (such as with partial swing shots, chip shots, etc.), the deformation does not reach the center. Thus, a higher spin rate is exhibited for lower speed swings as only the hard (relative to the core) cover layer 26 and mantle 24 contribute to the ball performance. This higher spin rate allows for more control and improved playability on partial shots and chip shots, while the low spin rate on high speed swings allows for more distance.

EXAMPLES

The following are non-limiting illustrative examples of golf balls in accordance with the principles of the present invention wherein certain teachings in each example can be combined and mixed in other embodiments thereby more fully illustrating the scope of the inventions.

Example Set I—Examples 1-4

Golf ball cores were made according to the following formula:

TABLE 1

| Core Formula | |
|---|---|
| Material | Phr |
| Enichem BR-40 polybutadiene | 100 |
| SR416D zinc diacrylate | 10 |
| Zinc oxide | 5 |
| Triganox 29/40 | 2.05 |
| Barytes | 15.5 |

This formula was designed to produce an uncured specific gravity of about 1.0873, which should produce a cured specific gravity (of the molded product) of between about 1.120 and 1.130. Golf ball cores of the above formula were molded to a diameter of about 1.375 inches. The cores described above were too soft to allow for measurement using the Wilson Dead Weight Deflection compression testing machine. The deflection of a test subject golf ball is taken by placing the ball between two round plates which are supported from below by round shafts. A force is then applied forcing the bottom plate to compress the ball into the upper plate, using a lever mechanism. The force applied is a nominal 200 lbs. The deflection is determined by taking the measured distance between the inside of the two plates at contact and the measured distance between the inside of the two plates at some time after the force is applied. The deflection is calculated by simple difference between the two measurements (Compression=180−(DWD*1000). The cores measure zero compression when measured on an Atti compression testing machine. The above referenced cores are used for all of the Examples of the invention.

Example 1

A golf ball was made in accordance with the principles of the present invention having a mantle injection molded around the core described above. The material used for molding the mantle was a terpolymer of ~76% ethylene, ~8.5% acrylic acid, and ~15.5% by weight n-butyl acrylate, wherein 100% of the acrylic acid groups were neutralized with magnesium ions. Further, the terpolymer comprises at least five phr of magnesium stearate. This material is available from DuPont, under the product number AD1016. The material was compounded to a specific gravity of 1.125, using titanium dioxide and barium sulfate as weight adjusting fillers. The molded mantle was glebarred (ground) to a diameter of about 1.560 inches.

The cover layer of the golf ball of Example 1 was molded using a blend of high-acid ionomers. Specifically, the cover layer was molded from a blend of: (1) about 60% by weight of a copolymer comprising ~81% by weight of ethylene and ~19% by weight of methacrylic acid, wherein ~40% to 70% of the carboxylic acid was neutralized using sodium ions; and (2) about 40% by weight of a copolymer comprising ~81% by weight of ethylene and ~19% by weight of methacrylic acid, wherein ~40% to 70% of the carboxylic acid was neutralized by Magnesium ions. The above described sodium high-acid ionomer is available from DuPont under the trade name Surlyn® 8140, and the above described magnesium high-acid ionomer is available from DuPont under the trade name Surlyn® 6120. The ionomer blend was further compounded with fillers to adjust the cover layer's specific gravity to ~1.125. Barium sulfate and titanium dioxide fillers were used to adjust the specific gravity of the cover layer material.

The golf ball of Example 1, utilizing a high-acid cover layer and AD1016 mantle 30, produced a ball deflection (under a 200 lb. static load) of about 0.129 inches, which is greater than the softest prior art balls (the Titleist® NXT Distance and the Precept® Laddie). Surprisingly, as set forth in Tables 3 and 4, below, the golf ball of Example 1 produces initial velocity properties that are faster than the softest prior art products, with comparable/longer flight distance properties. The golf ball of Example 1 also produces a low spin rate beneficial to the average golfer by reducing side spin, thereby reducing hooks and slices.

Example 2

A second golf ball was made in accordance with the principles of the present invention having a mantle injection molded around a core as utilized in Example 1. The material used for molding the mantle was a terpolymer of ~76% ethylene, ~8.5% acrylic acid, and ~15.5% by weight n-butyl acrylate, wherein 100% of the acrylic acid groups were neutralized with magnesium ions. Further, the terpolymer comprises at least five phr of magnesium stearate. This material is available from DuPont, under the product number AD1016. The material was further compounded to a specific gravity of ~1.125, using titanium dioxide and barium sulfate as weight adjusting fillers. The molded mantle was glebarred (ground) to a diameter of about 1.560 inches.

The cover layer of the golf ball of Example 2 was molded using a blend of high-acid ionomers. Specifically, the cover layer was molded from a blend of (1) about 55% by weight of a copolymer comprising ~81% by weight of ethylene and ~19% by weight of methacrylic acid, wherein ~40% to 70% of the carboxylic acid was neutralized with sodium ions, (2) about 32% by weight of a copolymer comprising ~81% by weight of ethylene and ~19% by weight of methacrylic acid, wherein ~40% to 70% of the carboxylic acid was neutralized with magnesium ions, and(3) about 13% by weight of a V.L.M.I. which is a terpolymer comprising ~70% by weight of ethylene, ~10% by weight of methacrylic acid, and ~20% by weight of n-butyl acrylate, wherein ~50% to 80% of the carboxylic acid was neutralized with magnesium ions.

The above described sodium high-acid ionomer is available from DuPont under the trade name Surlyn® 8140, the above described magnesium high-acid ionomer is available from DuPont under the trade name Surlyn® 6120, and the above described V.L.M.I. is available from DuPont under the trade name Surlyn® 6320. The ionomer blend was further compounded with fillers to adjust the cover layer specific gravity to ~1.125. Barium sulfate and titanium dioxide fillers were used to adjust the specific gravity of the cover layer material.

The golf ball of Example 2, utilizing a high-acid/V.L.M.I. blend cover layer and AD1016 mantle, produced ball deflection (under a 200 lb. static load) of about 0.134 inches, which is significantly higher than the softest prior art balls (the Titleist® NXT Distance and the Precept® Laddie). Surprisingly, as set forth in Tables 3 and 4, below, the golf ball of Example 2 produces initial velocity properties that are comparable to the softest prior art products, with comparable flight distance properties. The golf ball of Example 2 also produces a low spin rate beneficial to the average golfer by reducing side spin, thereby reducing hooks and slices.

Example 3

A third golf ball was made in accordance with the principles of the present invention having a mantle injection molded around the core utilized in Examples 1 and 2. The material used for molding the mantle was a terpolymer of ~74% ethylene, ~10.5% acrylic acid, and ~15.5% by weight n-butyl acrylate, wherein 100% of the acrylic acid groups was neutralized with magnesium ions. Further, the terpolymer comprises at least five phr of magnesium oleate. This material is available from DuPont, under the product number SEP 1200. The material was further compounded to a specific gravity of ~1.125, using zinc oxide, titanium dioxide and/or barium sulfate as weight adjusting fillers. The molded mantle was glebarred (ground) to a diameter of about 1.560 inches.

The cover layer of the golf ball of Example 3 was molded using a blend of high-acid ionomers. Specifically, the cover layer was molded from a blend of (1) about 60% by weight of a copolymer comprising ~81% by weight of ethylene and ~19% by weight of methacrylic acid, wherein ~40% to 70% of the carboxylic acid was neutralized using sodium ions, and (2) about 40% by weight of a copolymer comprising ~81% by weight of ethylene and ~19% by weight of methacrylic acid, wherein ~40% to 70% of the carboxylic acid was neutralized by Magnesium ions.

The above described Sodium high-acid ionomer is available from. DuPont under the trade name Surlyn® 8140, and the above described magnesium high-acid ionomer is available from DuPont under the trade name Surlyn® 6120. The ionomer blend was further compounded with fillers to adjust the cover layer specific gravity to ~1.125. Barium sulfate and titanium dioxide fillers were used to adjust the specific gravity of the cover layer material. The use of the SEP120 DuPont material as the mantle produced a lower compression ball than a similar ball made using AD1016 material as the mantle, with no loss in either initial velocity or flight performance properties.

The golf ball of Example 3, utilizing a high-acid cover layer and SEP1200 mantle, produced ball deflection of about 0.140 inches, which is significantly higher than the softest prior art balls (the Titleist® NXT Distance and the Precept® Laddie). Surprisingly, as set forth in Tables 3 and 4, below, the golf ball of Example 3 produces initial velocity properties that are faster than the softest prior art products, with comparable/longer flight distance properties. The golf ball of Example 3 also produces a low spin rate beneficial to the average golfer by reducing side spin, thereby reducing hooks and slices.

Example 4

A fourth golf ball was made in accordance with the principles of the present invention having a mantle injection molded around the core utilized in Examples 1 to 3. The material used for molding the mantle was a terpolymer of ~74% ethylene, ~10.5% acrylic acid, and ~15.5% by weight n-butyl acrylate, wherein 100% of the acrylic acid groups were neutralized with magnesium ions. Further, the terpolymer comprises at least five phr of magnesium oleate. This material is available from DuPont, under the product number SEP 1200. The material has been further compounded to a specific gravity of ~1.125, using zinc oxide, titanium dioxide and barium sulfate as weight adjusting fillers. The molded mantle was glebarred (ground) to a diameter of about 1.560 inches.

The cover layer of the golf ball of Example 4 was molded using a blend of high-acid ionomers. Specifically, the cover layer was molded from a blend of (1) about 55% by weight of a copolymer comprising ~81% by weight of ethylene and ~19% by weight of methacrylic acid, wherein ~40% to 70% of the carboxylic acid was neutralized with sodium ions, (2) about 32% by weight of a copolymer comprising ~81% by weight of ethylene and ~19% by weight of methacrylic acid, wherein ~40% to 70% of the carboxylic acid was neutralized with Magnesium ions, and (3) about 13% by weight of a V.L.M.I., which is a terpolymer comprising ~70% by weight of ethylene, ~10% by weight of methacrylic acid, and ~20% by weight of n-butyl acrylate, wherein ~50% to 80% of the carboxylic acid was neutralized with Magnesium ions.

The above described sodium high-acid ionomer is available from DuPont under the trade name Surlyn® 8140, the above described magnesium high-acid ionomer is available from DuPont under the trade name Surlyn® 6120, and the above described V.L.M.I. is available from DuPont under the trade name Surlyn® 6320. The ionomer blend was further compounded with fillers to adjust the cover layer specific gravity to ~1.125. Barium sulfate and titanium dioxide fillers were used to adjust the specific gravity of the cover layer material.

The golf ball of Example 4, utilizing a high-acid/V.L.M.I. blend cover layer and SEP 1200 mantle, produced ball deflection (under a 200 lb. static load) of about 0.144 inches, which is significantly higher than the softest prior art balls (the Titleist® NXT Distance and the Precept® Laddie). Surprisingly, as set forth in Tables 3 and 4, below, the golf ball of Example 4 produces initial velocity properties that are faster than the softest prior art products, with comparable/longer flight distance properties. The golf ball of Example 4 also produces a low spin rate beneficial to the average golfer by reducing side spin, thereby reducing hooks and slices.

The use of the SEP1200 DuPont material as the mantle produces a lower compression ball than a similar ball made using AD1016 material as the mantle, with no loss in either initial velocity or flight performance properties:

TABLE 2

| Mantle Properties | | | |
|---|---|---|---|
| Material | Size (in) | DWD (in) | Weight (g) |
| AD1O16 | 1.5560 | 0.2067 | 36.01 |
| SEP 1200 | 1.5592 | 0.2230 | 36.29 |

Dead Weight Deflection (DWD) was the amount of deflection measured under static load of 200 lb.

Mantles used in the examples of this invention yield a DWD of greater than about 0.200 inches under a static load of 200 lb., and a compression (correlated) of less than zero:

TABLE 3

| Golf Ball Physical Properties | | | | | | | | |
|---|---|---|---|---|---|---|---|---|
| | Size | Defl. | Weight | Shore | Coefficient Of Restitution | | | $V_i$ |
| Ball | (in) | (in) | (g) | D | 125 f/s | 150 f/s | 175 f/s | (yd) |
| Example 1 | 1.6818 | 0.1290 | 45.15 | 73 | 0.806 | 0.762 | 0.722 | 251.7 |
| Example 2 | 1.6831 | 0.1342 | 45.24 | 71 | 0.796 | 0.753 | 0.715 | 250.2 |
| Example 3 | 1.6827 | 0.1346 | 45.29 | 73 | 0.807 | 0.769 | | 252.1 |
| Example 4 | 1.6840 | 0.1445 | 45.35 | 71 | 0.800 | 0.758 | 0.723 | 250.8 |
| Staff ® Pro Distance | 1.6822 | 0.0933 | 45.34 | 71 | 0.824 | 0.794 | 0.759 | 255.3 |
| Straight Precept Laddie | 1.6805 | 0.1234 | 45.53 | 63 | 0.798 | 0.768 | 0.728 | 251.6 |
| Titleist NXT Distance | 1.6814 | 0.1121 | 45.38 | 65 | 0.801 | 0.765 | 0.729 | 251.1 |

Shore D Hardness was measured using a Shore D durometer (manufactured by Instron Corporation Headquarters, 100 Royall Street, Canton, Mass., 02021) with the hardness reading taken at surface of ball. Deflection (Defl.) was measured under 200 lb. applied load, using Wilson Dead Weight Deflection testing machine. Initial Velocity ($V_i$) as measured using Wilson Initial Velocity Test Machine. Coefficient of restitution (C.O.R.) was measured in testing by firing a golf ball at a steel plate at a known speed (125 ft/s; 150 ft/s; 175 ft/s), then recording the speed of the ball after impact with the steel plate. The ratio of outbound (after impact) velocity to inbound (before impact) velocity is the C.O.R.

TABLE 4

| Golf Ball Flight Performance Properties | | | | | | |
|---|---|---|---|---|---|---|
| Ball | Carry Dist. (yd) | Total Dist. (yd) | Apogee (yd) | Disp/Accy | $V_i$ (yd) | Driver Spin (rpm) |
| Example 1 | 246.2 | 259.2 | 9.7 | 6.3R/111 | 228.5 | 2471 |
| Example 2 | 243.4 | 256.6 | 9.6 | 5.0R/136 | 227.4 | 2501 |
| Example 3 | 245.1 | 258.3 | 9.7 | 6.5R/158 | 228.3 | 2429 |
| Example 4 | 244.6 | 257.5 | 9.8 | 5.8R/151 | 227.3 | 2416 |
| Staff ® Pro Distance | 255.6 | 263.2 | 10.0 | 1.4R/287 | 233.9 | 2707 |
| Straight Precept Laddie | 247.3 | 258.1 | 9.8 | 3.0R/121 | 227.5 | 2735 |
| Titleist NXT Distance | 248.2 | 257.0 | 9.8 | 2.5R/122 | 227.6 | 2739 |

Driver test results are an average of 3 tests at the following conditions: (1) club head velocity equals 230 ft/s and (2) the launch angle is 10.5°.

Golf balls made as in accordance with the principles of the present invention, using a very soft solid core, new DuPont modified terpolymer materials as the mantle, and a hard ionomer cover layer, result in significantly lower compression than currently possible with a two-piece golf ball. Although initial velocity properties are often proportional to compression a significantly lower compression is achieved than prior art products, and comparable or even somewhat improved initial velocity and flight performance properties are retained.

The result of the invention is a ball with good distance, lower spin rate than generally possible using a two-piece construction, and good initial velocity properties and flight performance (distance) properties.

Example Set II—Examples 5-30

Three different centers were mixed and molded as the basis for the golf balls of the Examples 5 through 30. The formulae used to mold the cores for the golf balls of Examples 5 through 30 were as follows:

TABLE 5

| Core Formula | | | |
|---|---|---|---|
| | PHR | | |
| Material | A | B | C |
| Enichem BR-40 polybutadiene | 100 | 100 | 100 |
| SR416D zinc diacrylate | 15 | 17.5 | 20 |
| Zinc oxide | 5 | 5 | 5 |
| Triganox 29/40 | 2.05 | 2.05 | 2.05 |
| Barytes | 13.2 | 12.1 | 11 |

This formula was designed to produce an uncured specific gravity of 1.0873, which produces a cured specific gravity (of the molded product) of between 1.120 inches and 1.130 inches.

Cores from formulae A and B were molded to two different target diameters: 1.125 inches and 1.25 inches. Cores molded from formula C were molded to 1.25 inches target diameter. Cores were measured for deflection under a 200 lb. static load using Wilson Dead Weight Deflection testing machine. Cores were also measured for size and weight. Three distinct deflection levels were achieved. Results of center properties were as follows:

TABLE 6

| Center Properties | | | |
|---|---|---|---|
| Center ID | Size (in) | DWD* (in) | Weight (g) |
| A (1.25 inch target) | 1.2446 | 0.2333 | 18.58 |
| A (1.125 inch target) | 1.1355 | 0.2228 | 14.11 |
| B (1.25 inch target) | 1.2476 | 0.1925 | 18.82 |
| B (1.125 inch target) | 1.1340 | 0.1901 | 13.95 |
| C (1.25 inch target) | 1.2464 | 0.1732 | 18.75 |

A first set of mantles, designated IL-1, were molded onto each of the experimental cores using DuPont® HPF™ AD1027, which is a terpolymer of ~73% to 74% ethylene, ~10.5% acrylic acid, and ~15.5% to 16.5% n-butyl acrylate, wherein 100% of the acid groups are neutralized with magnesium ions. Further, the terpolymer contains a fixed amount of greater than five phr magnesium oleate. This material is compounded to a specific gravity of ~1.125 using barium sulfate and titanium dioxide. The Shore D hardness of this material (as measured on the curved surface of the inner cover layer) is about 58-60.

A second set of mantles, designated IL-2, were molded onto each of the experimental cores using DuPont® Experimental HPF™ SEP 1264-3, which is a copolymer of ~88% ethylene and ~12% acrylic acid, wherein 100% of the acid groups are neutralized with magnesium ions. Further, the copolymer contains a fixed amount of at least five phr magnesium oleate. This material is compounded to a specific gravity of ~1.125 using zinc oxide. The Shore D hardness of this material (as measured on the curved surface of the inner cover layer) is about 61-64.

Mantles were injection molded onto the core using a Newbury injection press manufactured by Van Dorn Demag Corporation, 11792 Alameda, Strongsville, Ohio 44149. After molding, the core/mantle components were ground to a diameter of ~1.56 inches.

A first set of covers, designated C-1, were molded onto each of the core/mantle components using DuPont HPF® 1000, which is a terpolymer of ~75% to 76% ethylene, ~8.5% acrylic acid, and ~15.5% to 16.5% n-butyl acrylate, wherein 100% of the acid groups are neutralized with magnesium ions. Further, the terpolymer contains a fixed amount of at least five phr of magnesium stearate. This material is compounded to a target specific gravity of ~1.125 using barium sulfate and titanium dioxide. The Shore D hardness of this material (as measured on the curved surface of the molded golf ball) is about 60-62.

A second set of covers, designated C-2, were molded onto each of the core/mantle components using a blend of ionomers comprising: about 35% by weight of Surlyn® 8140, which is a copolymer comprising ~81% ethylene and ~19% methacrylic acid, wherein ~50% of the acid groups are neutralized with sodium ions, and about 65% by weight of Surlyn® 6320, which is a terpolymer comprising ~67% to 70% ethylene, ~10% methacrylic acid, and ~20% to 23% n-butyl acrylate, wherein ~70% of the acid groups are neutralized with magnesium ions. This material is compounded to a target specific gravity of ~1.125 using barium sulfate and titanium dioxide. The Shore D hardness of the ionomer blend (as measured on the curved surface of the golf ball) is about 58-60.

A third set of covers, designated C-3, were molded onto each of the core/mantle components using a blend of ionomers comprising: about 44% by weight of Surlyn® 8140, which is a copolymer comprising ~81% ethylene and ~19% methacrylic acid, wherein ~50% of the acid groups are neutralized with sodium ions, about 14% by weight of Surlyn® 6120, which is a copolymer comprising ~81% ethylene and ~19% methacrylic acid, wherein ~50-70% of the acid groups are neutralized with magnesium ions, and about 42% by weight of Surlyn® 6320, which is a terpolymer comprising ~67% to 70% ethylene, ~10% methacrylic acid, and ~20% to 23% n-butyl acrylate, wherein ~70% of the acid groups are neutralized with magnesium ions. This material is compounded to a target specific gravity of ~1.125 using barium sulfate and titanium dioxide. The Shore D hardness of the ionomer blend (as measured on the curved surface of the golf ball) is about 64-65.

Covers were molded onto center/mantle components using a Nissei injection press available from Nissei America, Inc., 1480 North Hancock Street, Anaheim, Calif. 92807. All balls molded using Wilson WS-400 dimple pattern, which employs three different dimple sizes laid out in a rhombicuboctahedron pattern.

Results of examples of the invention are as follows:

Examples of the Invention Using DuPont HPF® Cover

TABLE 7

Construction of Examples 5-14 (Made using cover blend C-1 - DuPont HPF ® 1000 - cover Shore D hardness 60-62)

| | Example # | | | | | | | | | |
|---|---|---|---|---|---|---|---|---|---|---|
| | 5 | 6 | 7 | 8 | 9 | 10 | 11 | 12 | 13 | 14 |
| Core | B | B | B | B | C | C | A | A | A | A |
| ID/Size(in) | 1.25 | 1.25 | 1.125 | 1.125 | 1.25 | 1.25 | 1.125 | 1.125 | 1.25 | 1.25 |
| Mantle | IL-1 | IL-2 | IL-1 | IL-2 | IL-1 | IL-2 | IL-1 | IL-2 | IL-1 | IL-2 |
| Cover | C-1 | C-1 | C-1 | C-1 | C-1 | C-1 | C-1 | C-1 | C-1 | C-1 |

The balls of Examples 5-14 were tested for physical and flight properties. For reference, the Titleist Pro V1 was also tested for physical and flight properties:

TABLE 8

Physical/Flight Properties of Examples 5-14

| | Physical Properties | | | Flight properties | | | | |
|---|---|---|---|---|---|---|---|---|
| Ex # | Size (in) | DWD (in) | Wt. (g) | Carry (yd) | Total (yd) | I.V. (yd) | Spin (rpm) | 9I Spin (rpm) |
| 5 | 1.6857 | 0.1112 | 45.63 | 243.9 | 248.1 | 231.6 | 2621 | 7189 |
| 6 | 1.6858 | 0.0949 | 45.61 | 244.8 | 250.6 | 233.8 | 2757 | 7318 |
| 7 | 1.6826 | 0.1049 | 45.30 | 246.9 | 251.6 | 232.9 | 2585 | 7242 |
| 8 | 1.6821 | 0.0852 | 45.46 | 251.6 | 254.8 | 234.1 | 2694 | 7499 |
| 9 | 1.6852 | 0.1056 | 45.51 | 247.1 | 249.5 | 232.8 | 2767 | 7380 |
| 10 | 1.6843 | 0.0904 | 45.58 | 248.5 | 251.1 | 233.8 | 2722 | 7497 |
| 11 | 1.6870 | 0.1085 | 45.43 | 241.4 | 245.8 | 232.5 | 2620 | 7303 |
| 12 | 1.6831 | 0.0876 | 45.50 | 246.1 | 250.6 | 234.3 | 2741 | 7448 |
| 13 | 1.6844 | 0.1238 | 45.32 | 241.4 | 246.0 | 231.3 | 2619 | 6804 |
| 14 | 1.6852 | 0.1056 | 45.40 | 241.3 | 244.1 | 232.7 | 2640 | 7151 |
| Pro V1 | 1.6847 | 0.0936 | 45.60 | 246.1 | 247.1 | 230.6 | 3415 | 7998 |

Flight test results used an average of 12 data points. Flight testing was performed using True Temper testing machine available from True Temper Sports, Inc., 8275 Tournament Dr. Ste. 200 Memphis, Tenn. 38125-8899. For driver testing, a Wilson Staff® Titanium Driver club was used, with a 9.0° loft using club head velocity of 160 ft/s. For 9-Iron testing a Wilson Staff® 9-Iron using club head velocity of ~113 ft/s. A summary of the flight test results is set forth below:

The golf ball of Example 5 produces a greater deflection (0.018 inches—corresponds to a lower ball compression) under 200 lb. static load, lower Driver spin rate and higher initial velocity than the Titleist Pro V1 comparative example.

The golf ball of Example 6 produces comparable deflection (compression) under 200 lb. static load, significantly higher initial velocity, lower spin rate and increased distance of ~3.5 yd. as compared to the Titleist Pro V1 comparative example.

The golf ball of Example 7 produces a greater deflection (~0.011 inches) under 200 lb. static load, significantly higher initial velocity, lower spin rate and increased distance of ~4.5 yd. as compared to the Titleist Pro V1 comparative example.

The golf ball of Example 8 produces less deflection (~0.009 inches) under 200 lb. static load, significantly higher initial velocity, lower spin rate and increased distance of ~7.7 yd. as compared to the Titleist Pro V1 comparative example.

The golf ball of Example 9 produces a greater deflection (~0.012 inches) under 200 lb. static load, significantly higher initial velocity, lower spin rate and increased distance of ~2.0 yd. as compared to the Titleist Pro V1 comparative example.

The golf ball of Example 10 produces comparable deflection (compression) under 200 lb. static load, significantly higher initial velocity, lower spin rate and increased distance of ~4.0 yd. as compared to the Titleist Pro V1 comparative example.

The golf ball of Example 11 produces a greater deflection (~0.015 inches) under 200 lb. static load, lower Driver spin rate and higher initial velocity than the Titleist Pro V1 comparative example.

The golf ball of Example 12 produces slightly less deflection (0.006 inches) under 200 lb. static load, significantly higher initial velocity, lower spin rate and increased distance of ~3.5 yd. as compared to the Titleist Pro V1 comparative example.

The golf ball of Example 13 produces a greater deflection (0.012 inches) under 200 lb. static load, lower Driver spin rate and higher initial velocity than the Titleist Pro V1 comparative example.

The golf ball of Example 14 produces a greater deflection (0.030 inches) under 200 lb. static load, lower Driver spin rate and higher initial velocity than the Titleist Pro V1 comparative example.

Overall, Examples 5-14 of the invention molded using the DuPont HPF® cover all produce higher initial velocity properties than the Titleist Pro V1 comparative example. The Examples 5-14 also produce a significantly lower spin rate off of the Driver club. Further, balls that have a comparable deflection under 200 lb. static load produce significantly higher initial velocity properties (an increase of 3.2 to 4.7 ft/s) and longer distance performance (an increase of 3.5 to 7.7 yd.) than the Titleist Pro V1 comparative example.

Examples of the Invention Using Soft DuPont Surlyn® Cover Blend

TABLE 9

Construction of Examples 15-21 (Made using cover blend C-2 - Blend of Du Pont Surlyn ® 8140 and Surlyn ® 6320 @ 35/65 - cover Shore D hardness 58-60)

| | Example #: | | | | | | |
|---|---|---|---|---|---|---|---|
| | 15 | 16 | 17 | 18 | 19 | 20 | 21 |
| Core | B | B | B | C | C | A | A |
| ID/Size (in) | 1.25 | 1.125 | 1.125 | 1.25 | 1.25 | 1.125 | 1.125 |
| Mantle | IL-2 | IL-1 | IL-2 | IL-1 | IL-2 | IL-1 | IL-2 |
| Cover | C-2 | C-2 | C-2 | C-2 | C-2 | C-2 | C-2 |

The balls of Examples 15-21 were tested for physical and flight properties. For reference, the Titleist Pro V1 was also tested for physical and flight properties.

TABLE 10

Physical/Flight Properties of Examples 15-21

| | Physical Properties | | | Flight properties | | | | |
|---|---|---|---|---|---|---|---|---|
| Ex # | Size (in) | DWD (in) | Wt. (g) | Carry (yd) | Total (yd) | I.V. (yd) | Spin (rpm) | 9I Spin (rpm) |
| 15 | 1.6834 | 0.1119 | 45.55 | 250.3 | 259.0 | 231.8 | 2651 | 6968 |
| 16 | 1.6819 | 0.1076 | 45.27 | 248.1 | 257.0 | 231.5 | 2524 | 6840 |
| 17 | 1.6831 | 0.0870 | 45.39 | 254.3 | 262.0 | 233.9 | 2693 | 7138 |
| 18 | 1.6843 | 0.1114 | 45.47 | 250.0 | 254.6 | 231.5 | 2622 | 7077 |
| 19 | 1.6850 | 0.0919 | 45.57 | 254.4 | 260.8 | 233.2 | 2713 | 7043 |
| 20 | 1.6867 | 0.1067 | 45.56 | 248.1 | 253.9 | 231.9 | 2483 | 7021 |
| 21 | 1.6840 | 0.0888 | 45.45 | 252.4 | 260.0 | 233.5 | 2545 | 7165 |
| Pro V1 | 1.6847 | 0.0936 | 45.60 | 250.4 | 252.6 | 230.8 | 3369 | 7932 |

Flight test results used an average of 12 data points. Flight testing was performed using True Temper testing machine. For driver testing, a Wilson Staff® Titanium Driver club was used, with a 9.0° loft using club head velocity of ~160 ft/s. For 9-Iron testing a Wilson Staff® 9-iron using club head velocity of ~113 ft/s. A summary of the flight test results is set forth below:

The golf ball of Example 15 produces a greater deflection (~0.018 inches) under 200 lb. static load, higher initial velocity, lower spin rate and increased distance of ~6.2 yd. as compared to the Titleist Pro V1 comparative example.

The golf ball of Example 16 produces a greater deflection (~0.014 inches) under 200 lb. static load, higher initial velocity, lower spin rate and increased distance of ~4.4 yd. as compared to the Titleist Pro V1 comparative example.

The golf ball of Example 17 produces slightly less deflection (~0.006 inches) under 200 lb. static load, significantly higher initial velocity, lower spin rate and increased distance of ~9.4 yd. as compared to the Titleist Pro V1 comparative example.

The golf ball of Example 18 produces a greater deflection (~0.018 inches) under 200 lb. static load, higher initial velocity, lower spin rate and increased distance of ~2.0 yd. as compared to the Titleist Pro V1 comparative example.

The golf ball of Example 19 produces comparable deflection under 200 lb. static load, significantly higher initial velocity, lower spin rate and increased distance of ~8.2 yd. as compared to the Titleist Pro V1 comparative example.

The golf ball of Example 20 produces a greater deflection (~0.013 inches) under 200 lb. static load, higher initial velocity, lower spin rate and increased distance of ~1.3 yd. as compared to the Titleist Pro V1 comparative example.

The golf ball of Example 21 produces slightly less deflection (~0.006 inches) under 200 lb. static load, significantly higher initial velocity, lower spin rate and increased distance of ~7.4 yd. as compared to the Titleist Pro V1 comparative example.

Overall, Examples 15-21 of the invention molded using a soft Surlyn® cover blend (Surlyn® 8140/Surlyn® 6320@35/65) produce higher initial velocity properties than the Titleist Pro V1 comparative example. Examples 15-21 also produce a significantly lower spin rate off of the Driver club. Further, balls that have a comparable deflection under 200 lb. static load produce significantly higher initial velocity properties (an increase of ~2.5 ft/s) and longer distance performance (an increase of 7.5 to 10 yd.) than the Titleist Pro V1 comparative example.

Examples of the Invention Using Intermediate Hardness DuPont Surlyn® Cover Blend

TABLE 11

Construction of Examples 22-30 (Made using cover blend C-3 - Blend of DuPont Surlyn ® 8140, Surlyn ® 6120 and Surlyn ® 6320 at a ratio of 44/14/42 - cover Shore D hardness 64-65)

| | Example # | | | | | | | | |
|---|---|---|---|---|---|---|---|---|---|
| | 22 | 23 | 24 | 25 | 26 | 27 | 28 | 29 | 30 |
| Core | B | B | B | B | C | C | A | A | A |
| ID/ Size (in) | 1.25 | 1.25 | 1.125 | 1.125 | 1.25 | 1.25 | 1.125 | 1.125 | 1.25 |
| Mantle | IL-1 | IL-2 | IL-1 | IL-2 | IL-1 | IL-2 | IL-1 | IL-2 | IL-2 |
| Cover | C-3 | C-3 | C-3 | C-3 | C-3 | C-3 | C-3 | C-3 | C-3 |

The balls of Examples 22-30 were tested for physical and flight properties. For reference, the Titleist Pro V1 was also tested for physical and flight properties.

TABLE 12

Physicai/Flight Properties of Examples 22-30

| | Physical Properties | | | Flight properties | | | | |
|---|---|---|---|---|---|---|---|---|
| Ex # | Size (in) | DWD (in) | Wt. (g) | Carry (yd) | Total (yd) | I.V. (yd) | Spin (rpm) | 9I Spin (rpm) |
| 22 | 1.6845 | 0.1071 | 45.56 | 248.8 | 253.6 | 231.9 | 2579 | 7043 |
| 23 | 1.6854 | 0.0899 | 45.61 | 250.6 | 254.9 | 233.3 | 2769 | 7054 |
| 24 | 1.6861 | 0.1006 | 45.30 | 249.9 | 253.4 | 233.3 | 2715 | 7126 |
| 25 | 1.6862 | 0.0823 | 45.43 | 250.5 | 254.8 | 235.2 | 2700 | 7197 |
| 26 | 1.6885 | 0.0995 | 45.73 | 251.5 | 255.6 | 232.6 | 2709 | 7180 |
| 27 | 1.6880 | 0.0844 | 45.83 | 254.4 | 256.3 | 234.6 | 2820 | 7421 |
| 28 | 1.6837 | 0.1035 | 45.37 | 249.4 | 251.6 | 232.5 | 2777 | 7068 |
| 29 | 1.6847 | 0.0836 | 45.49 | 254.6 | 259.6 | 234.9 | 2718 | 7349 |
| 30 | 1.6861 | 0.0963 | 45.42 | 246.5 | 250.8 | 232.6 | 2697 | 7592 |
| Pro V1 | 1.6847 | 0.0936 | 45.60 | 246.3 | 247.0 | 230.7 | 3330 | 7999 |

Flight test results used an average of 12 data points. Flight testing was performed using True Temper testing machine. For driver testing, a Wilson Staff® Titanium Driver club was used, with a 9.0° loft using club head velocity of ~160 ft/s. For 9-Iron testing a Wilson Staff® 9-iron using club head velocity of ~113 ft/s. A summary of the flight test results is set forth below:

The golf ball of Example 22 produces a greater deflection (0.014 inches—corresponds to a lower ball compression) under 200 lb. static load, lower Driver spin rate, higher initial velocity, and increased distance of ~6.6 yd. as compared to the Titleist Pro V1 comparative example.

The golf ball of Example 23 produces comparable deflection (compression) under 200 lb. static load, significantly higher initial velocity, lower spin rate and increased distance of ~7.9 yd. as compared to the Titleist Pro V1 comparative example.

The golf ball of Example 24 produces a greater deflection (~0.007 inches) under 200 lb. static load, significantly higher initial velocity, lower spin rate and increased distance of ~6.4 yd. as compared to the Titleist Pro V1 comparative example.

The golf ball of Example 25 produces less deflection (~0.011 inches) under 200 lb. static load, significantly higher initial velocity, lower spin rate and increased distance of ~7.8 yd. as compared to the Titleist Pro V1 comparative example.

The golf ball of Example 26 produces a greater deflection (~0.006 inches) under 200 lb. static load, significantly higher initial velocity, lower spin rate and increased distance of ~8.6 yd. as compared to the Titleist Pro V1 comparative example.

The golf ball of Example 27 produces less deflection (~0.009 inches) under 200 lb. static load, significantly higher initial velocity, lower Driver spin rate and increased distance of ~9.3 yd. as compared to the Titleist Pro V1 comparative example.

The golf ball of Example 28 produces a greater deflection (~0.010 inches) under 200 lb. static load, significantly higher initial velocity, lower Driver spin rate and increased distance of ~4.6 yd. as compared to the Titleist Pro V1 comparative example.

The golf ball of Example 29 produces less deflection (~0.010 inches) under 200 lb. static load, significantly higher initial velocity, lower spin rate and increased distance of ~12.6 yd. as compared to the Titleist Pro V1 comparative example.

The golf ball of Example 30 produces a slightly greater deflection (~0.003 inches) under 200 lb. static load, significantly higher initial velocity, lower Driver spin rate and increased distance of ~3.8 yd. as compared to the Titleist Pro V1 comparative example.

Overall, Examples 22-30 of the invention, molded using a soft Surlyn® cover blend (Surlyn® 8140/Surlyn® 6120/Surlyn® 6320@44/14/42) produce higher initial velocity properties than the Titleist Pro V1 comparative example. Examples 22-30 also produce a significantly lower spin rate off of the Driver club. Further, balls that have a comparable deflection under 200 lb. static load produce significantly higher initial velocity properties (an increase of ~2.5 ft/s) and longer distance performance (an increase of 7.5 to 10 yd.) than the Titleist Pro V1 comparative example.

In summary, balls made in accordance with the principles of the present invention produce exceptional initial velocity properties when struck by a Driver club, low spin rates when struck by a Driver club, high deflection under 200 lb. static load (corresponding to good feel properties) and exceptional distance properties. Further, as the swing speed of the club decreases (less than a full swing by the golfer) the soft center has less influence on the reaction (performance) properties of the ball. Therefore, the relatively stiff thermoplastic inner cover layer(s) and the soft outer cover layer combine to produce improved performance (control, spin) on golf shots near the green. In addition, the balanced nature of one embodiment of the present invention allows for more precise control of ball placement both off of the tee and on the green.

It should be understood that various changes and modifications preferred in to the embodiment described herein would be apparent to those skilled in the art. Such changes and modifications can be made without departing from the spirit and scope of the present invention and without demising its attendant advantages. It is therefore intended that such changes and modifications be covered by the appended claims.

What is claimed is:

1. A golf ball comprising:

a core comprising a high cis-content polybutadiene rubber, a co-crosslinking agent, and a free radical initiator, the core having a deflection, under an applied static load of 200 lb., of greater than about 0.160 inches;

an inner layer comprising about 60% to about 80% ethylene, from about 8% to about 20% by weight of an α, β-unsaturated carboxylic acid and from about 5% to about 25% of an n-alkyl acrylate, about 100% of the carboxylic acid of the inner layer being neutralized with metal ions; and a cover layer comprising about 80% to about 82% by weight of ethylene and about 18% to 20% of weight of an α, β-unsaturated carboxylic acid, and having a shore D hardness within the range of 50 to 75.

2. The golf ball of claim 1, wherein the co-crosslinking agent of the core comprises a zinc salt of an unsaturated acrylate ester, and wherein the zinc salt comprises zinc diacrylate.

3. The golf ball of claim 2, wherein the quantity of zinc diacrylate within the core is in a quantity of within the range of 10 Phr to 20 Phr.

4. The golf ball of claim 1, wherein the cover layer has a shore D hardness within the range of 50 to 75.

5. The golf ball of claim 4, wherein the cover layer has a shore D hardness within the range of 68 to 73.

6. The golf ball of claim 1, wherein the golf ball, when struck by a driver club at a club head velocity of about 160 ft/s, has an initial velocity off the club head of greater than about 231 ft/s.

7. The golf ball of claim 1, wherein the core, the inner layer, and the cover layer each have a specific gravity within the range of 1.118 to 1.132.

8. The golf ball of claim 7, wherein the core, the inner layer, and the cover layer each have a specific gravity of 1.125.

9. The golf ball of claim 1, wherein the core has a diameter of less than 1.375 inches.

10. The golf ball of claim 1, wherein the golf ball has a deflection, under an applied static load of 200 lb., of greater than 0.080 inches.

11. A golf ball comprising:

a core comprising a high cis-content polybutadiene rubber, a co-crosslinking agent, and a free radical initiator, the core having a deflection, under an applied static load of 200 lb., of greater than about 0.160 inches;

an inner layer comprising about 60% to about 80% ethylene, from about 8% to about 20% by weight of an α, β-unsaturated carboxylic acid and from about 5% to about 25% of an n-alkyl acrylate, about 100% of the carboxylic acid of the inner layer being neutralized with metal ions; and a cover layer comprising a terpolymer comprising about 80% to about 82% by weight of ethylene and about 18% to about 20% of weight of an α, β-unsaturated carboxylic acid, the cover layer further comprising a very low modulus ionomer comprising from about 67% to about 70% by weight of ethylene, about 10% by weight of an α, β-unsaturated carboxylic acid, and from about 20% to about 23% by weight of an n-alkyl acrylate.

12. The golf ball of claim 11, wherein the golf ball, when struck by a driver club at a club head velocity of about 160 ft/s, has an initial velocity off the club head of greater than about 231 ft/s.

13. The golf ball of claim 11, wherein about 40% to about 70% of the carboxylic acid groups of the terpolymer of the cover layer are neutralized with a metal ion and further wherein about 70% of the carboxylic acid groups of the very low modulus ionomer are neutralized with a metal ion.

14. The golf ball of claim 11, wherein the carboxylic acid groups of the terpolymer of the cover layer are neutralized by a mono-valent metal ion and further wherein the carboxylic acid groups of the very low modulus ionomer of the cover layer are neutralized using a di-valent ionomer.

15. The golf ball of claim 11, wherein the co-crosslinking agent of the core comprising a zinc salt of an unsaturated acrylate ester, and wherein the zinc salt comprises zinc diacrylate.

16. The golf ball of claim 15, wherein the quantity of zinc diacrylate within the core is in a quantity of within the range of 10 Phr to 20 Phr.

17. The golf ball of claim 11, wherein the core, the inner layer, and the cover layer each have a specific gravity within the range of 1.118 to 1.132.

18. The golf ball of claim 11, wherein the core has a diameter of less than 1.375 inches.

19. The golf ball of claim 11, wherein the golf ball has a deflection, under an applied static load of 200 lb., of greater than 0.080 inches.

20. The golf ball of claim 11, wherein the cover layer has a shore D hardness within the range of 68 to 73.

* * * * *